US012808124B2

(12) United States Patent
Karisalmi

(10) Patent No.: US 12,808,124 B2
(45) Date of Patent: Nov. 24, 2026

(54) MOISTURE AND OIL BARRIER

(71) Applicant: Kemira Oyj, Helsinki (FI)

(72) Inventor: Kaisa Karisalmi, Helsinki (FI)

(73) Assignee: Kemira Oyj, Helsinki (FI)

( * ) Notice: Subject to any disclaimer, the term of this patent is extended or adjusted under 35 U.S.C. 154(b) by 128 days.

(21) Appl. No.: 18/563,704

(22) PCT Filed: May 25, 2022

(86) PCT No.: PCT/EP2022/064314
§ 371 (c)(1),
(2) Date: Nov. 22, 2023

(87) PCT Pub. No.: WO2022/248611
PCT Pub. Date: Dec. 1, 2022

(65) Prior Publication Data

US 2024/0301628 A1 Sep. 12, 2024

(30) Foreign Application Priority Data

May 27, 2021 (GB) ..... 2107574

(51) Int. Cl.
*D21H 19/34* (2006.01)
*D21H 21/16* (2006.01)
*D21H 27/10* (2006.01)

(52) U.S. Cl.
CPC ..... *D21H 19/34* (2013.01); *D21H 21/16* (2013.01); *D21H 27/10* (2013.01)

(58) Field of Classification Search
None
See application file for complete search history.

(56) References Cited

U.S. PATENT DOCUMENTS 4,122,234 A 10/1978 Lohoff
4,158,649 A 6/1979 Angres et al.
4,729,793 A 3/1988 Eckenhoff et al.
2004/0180993 A1 9/2004 Shelton et al.
2006/0229512 A1* 10/2006 Petisce ..... A61B 5/6849 600/347
2008/0281042 A1 11/2008 Soane et al.
2009/0096962 A1 4/2009 Shelton et al.

FOREIGN PATENT DOCUMENTS

| | | | |
|---|---|---|---|
| CN | 101223192 | A | 7/2008 |
| EP | 1874826 | A1 | 1/2008 |
| KR | 1020150031519 | A | 3/2015 |
| TW | 201226452 | A | 7/2012 |
| WO | 2004/087812 | A1 | 10/2004 |
| WO | 2006/116367 | A1 | 11/2006 |
| WO | 2008/036315 | A2 | 3/2008 |
| WO | 2008/143765 | A2 | 11/2008 |

OTHER PUBLICATIONS

Office Action, China National Intellectual Property Administration, Application No. 202280030442.3, Jul. 10, 2025.
Billet, Aina, International Searching Authority, European Patent Office, PCT/EP2022/064314, Sep. 9, 2022.
Scott, Jason, Office Action, The Intellectual Property Office of the United Kingdom, GB1207574.2, Feb. 1, 2022.

* cited by examiner

*Primary Examiner* — Sheeba Ahmed
(74) *Attorney, Agent, or Firm* — Gavrilovich, Dodd & Lindsey LLP

(57) ABSTRACT

Provided is the use of a film of a cellulose ester as a barrier against moisture and oil. The cellulose ester has free hydroxyl groups and ester substituents. The ester substituents are each individually selected from C1 to C6 alkyl ester groups. The free hydroxyl groups are present in an amount in the range 15% to 40 mol %. The film is useful as a barrier layer for food packaging. Also provided is a composition comprising the cellulose ester and a further film-forming material, a packaging material comprising a film of the composition, and a method for manufacturing the packaging material.

18 Claims, 5 Drawing Sheets

MOISTURE AND OIL BARRIER

CROSS REFERENCE TO RELATED APPLICATIONS

This application is a U.S. National Phase Application filed under 35 U.S.C. § 371 and claims priority to International Application No. PCT/EP2022/064314, filed on May 25, 2022, which application claims priority to Great Britain Application No. 2107574.2, filed May 27, 2021, the disclosures of which are incorporated herein by reference.

BACKGROUND

Plastic packaging materials are commonly used to package foods and beverages. Plastics are inexpensive to manufacture and to transport, and are effective barriers against moisture and oil and grease. However, plastics have a significant environmental impact. For example, most plastics are produced from non-renewable resources and are not biodegradable. There is an increasing desire to reduce the amount of plastic waste.

Glass and metal packaging may be used as alternatives to plastics. These materials have good barrier properties, and can readily be recycled. However, glass and metal suffer from the drawbacks that they are expensive to manufacture and to transport.

Paperboard is an attractive material from an environmental standpoint, because it is manufactured from renewable materials and is biodegradable. However, paperboard is porous and absorbent, and does not have adequate moisture and oil and grease barrier properties.

There remains a need in the art for cost-effective packaging materials with less environmental impact.

WO 2019/060694 A1 discloses a substrate having a coating comprising a cellulose acetate film. The cellulose acetate film has a glass transition temperature of at least 140°:

SUMMARY

In one aspect, there is provided a composition comprising a mixture of a cellulose ester and a further film-forming material. The cellulose ester and the further film-forming material are present in the composition at a ratio in the range 0.1:1 to 10:1 by weight. The cellulose ester has ester substituents and free hydroxyl groups. The ester substituents of the cellulose ester are each independently selected from C2 to C6 alkyl ester groups. The free hydroxyl groups of the cellulose ester are present in an amount in the range 15 to 40 mol %. The further film-forming material is selected such that, when the composition is dissolved in ethylene glycol diacetate, the resultant solution has a viscosity of less than or equal to 7500 mPa·s as measured at a temperature of 22±1° C. using a Brookfield viscometer operating at a spindle speed of 60 rpm. The spindle may be an LV 4 spindle.

The composition may be in the form of a film. The film may be a continuous film arranged on a surface of a substrate.

A related aspect provides the use of the film as a barrier against moisture and oil.

In another aspect, there is provided the use of a film of a cellulose ester as a barrier against moisture and oil, the cellulose ester having free hydroxyl groups and ester substituents. The ester substituents are each individually selected from C1 to C6 alkyl ester groups. The free hydroxyl groups are present in an amount in the range 15 to 40 mol %.

BRIEF DESCRIPTION OF THE DRAWINGS

To assist understanding of embodiments of the present invention and to show how such embodiments may be put into effect, reference is made, by way of example only, to the accompanying drawings in which.

DETAILED DESCRIPTION

As used herein, the verb 'to comprise' is used as shorthand for 'to include or to consist of'. In other words, although the verb 'to comprise' is intended to be an open term, the replacement of this term with the closed term 'to consist of' is explicitly contemplated, particularly where used in connection with chemical compositions.

All molecular weights reported herein are number average molecular weights, MWn, unless otherwise stated.

"Tg" refers to the glass transition temperature. All glass transition temperatures reported herein were measured at a pressure of 101 kPa (i.e., 1 atm).

"CA" stands for cellulose acetate. "CAB" stands for cellulose acetate butyrate. "NMR" stands for nuclear magnetic resonance. "EGDA" stands for ethylene glycol diacetate. "PEG" stands for polyethylene glycol.

Cellulose is a polymer made up of β(1→4) linked D-glucose units. In an underivatized state, each D-glucose unit includes three free hydroxyl groups. In a cellulose derivative, some or all of these hydroxyl groups are derivatised, e.g. esterified. The relative proportions of free- and derivatized-hydroxyl groups may be expressed in mol %, based on the number of D-glucose units in the cellulose backbone divided by three. By way of illustration, a cellulose derivative in which each D-glucose unit bears two free hydroxyl groups and one acetyl group may be described as having a free hydroxyl content of 66.66 mol % and an acetyl content of 33.33 mol %.

The amount of a given substituent present in a cellulose derivative may be measured by $^{13}C$ NMR spectroscopy, for example using the technique described in Example 1.

Viscosity is measured using a Brookfield viscometer operating at a spindle speed of 60 rpm. The viscometer may in particular be a Brookfield model DV viscometer. The spindle may in particular be a Brookfield LV 4 spindle (which may also referred to by its spindle code, 64). Viscosity measurements are performed at room temperature, i.e. 22±1° C. For the purposes of measuring viscosity, a sample of the composition may be dissolved in ethylene glycol diacetate. The resulting solution may comprise 30 wt % of the composition, based on the weight of the solution.

Although in practical use the composition may of course be used under conditions which differ from those used for assessing viscosity, the present set of conditions has been found to be useful for assessing the handleability of the composition.

Provided herein are packaging materials which include a film comprising a cellulose ester. It has surprisingly been found that certain cellulose esters provide an effective barrier against both moisture and oil and grease. The cellulose esters may be formulated into blends which have improved handling characteristics compared to the cellulose ester alone, while still retaining the favourable moisture and oil and grease barrier properties.

Figure 1:
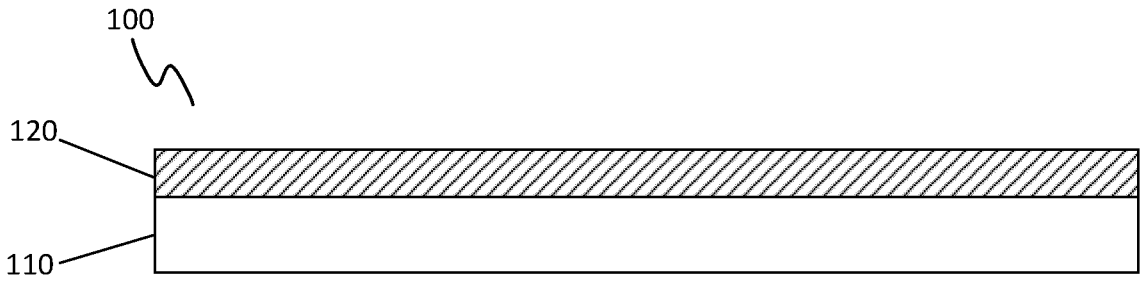
FIG. 1 is a schematic cross-section of a packaging material.

The structure of a packaging material will first be explained with reference to FIG. 1. FIG. 1 shows a schematic cross-section of an example packaging material 100.

Packaging material 100 includes a substrate 110. The nature of the substrate is not particularly limited and may be selected as appropriate. The substrate may comprise a cellulosic material, such as paperboard. Paperboard is biodegradable and obtainable from renewable resources. Other substrates, such as aluminium, may be used.

A film 120 comprising a cellulose ester is arranged on a top surface of substrate 110. Film 120 acts as a moisture and oil and grease barrier for restricting the diffusion of water and oil/grease to and from the substrate 110. To this end, film 120 is a continuous, unbroken film. Packaging material 100 may be used to package a food or beverage. In use, film 120 will be in contact with the food or beverage.

Many variants of the structure illustrated in FIG. 1 are possible.

Substrate 110 is illustrated as a single layer in FIG. 1, but may alternatively comprise a plurality of layers. For example, substrate 110 may comprise a boxboard.

FIG. 1 shows a single film 120 on the top surface of substrate 110. In variants, an additional film may be provided on the bottom surface of the substrate.

Cellulose esters useful as barriers against moisture and oil, e.g. in film 120, will now be explained in detail.

The cellulose ester has free hydroxyl groups and ester substituents. The ester substituents are each individually selected from C1 to C6 alkyl ester groups. The free hydroxyl groups are present in an amount in the range 15 to 40 mol %. It has surprisingly been found that by providing a cellulose ester comprising free hydroxyl groups are present in an amount in the range 15 to 40 mol %, a film which is effective as a barrier against both moisture and oil and grease is obtained.

Optionally, the free hydroxyl groups may be present in an amount in the range 15 to 30 mol %, further optionally 25% to 30 mol %. The Examples below demonstrate that cellulose esters having amounts of free hydroxyl groups within these ranges have particularly good oil and grease barrier properties.

The C1 to C6 alkyl ester groups are preferably each individually selected from acetate ester groups, propionate ester groups, and butyrate ester groups.

The cellulose ester may comprise one type of alkyl ester group, i.e. each of the alkyl ester groups may comprise the same group. For example, the cellulose ester may be cellulose acetate. Alternatively, the cellulose ester may comprise two or more different types of alkyl ester group. Examples of such cellulose esters include cellulose acetate propionate and cellulose acetate butyrate.

The cellulose ester may be substantially free of substituents other than the ester groups and the free hydroxyl groups. By "substantially free" it is meant that the cellulose ester does not comprise any other substituents to within ordinary manufacturing tolerances. For example, any other substituents may be present in a total amount of less than or equal to 1 mol %, optionally 0.1 mol %, further optionally 0.01 mol %.

Alternatively, the cellulose ester may further comprise carboxyalkyl substituents. The carboxyalkyl substituents may be selected from carboxymethyl, carboxyethyl, and carboxypropyl groups. In particular, the cellulose ester may include carboxymethyl substituents.

The carboxyalkyl substituents may be present in an amount in the range 1 to 25 mol %, optionally 1 to 10 mol %, further optionally 1 to 5 mol %. The cellulose ester may be substantially free of substituents other than the alkyl ester groups, the carboxyalkyl substituents, and the free hydroxyl groups.

Particularly preferably, the cellulose ester may be a cellulose acetate butyrate.

The cellulose acetate butyrate may comprise butyl groups in an amount of up to 80 mol %, optionally 40 to 60 mol %.

The cellulose acetate butyrate may comprise acetyl groups in an amount in the range 0.5 to 10 mol %, optionally 2 to 5 mol %.

For example, the cellulose acetate butyrate may comprise butyl groups in an amount in the range 65 to 75 mol %, and acetyl groups in an amount in the range 2 to 5 mol %.

A particularly preferred cellulose acetate butyrate comprises butyl groups in an amount in the range 65 to 75 mol %, acetyl groups in an amount in the range 2 to 5 mol %, and free hydroxyl groups in an amount of 25 to 30 mol %. The cellulose acetate butyrate of this example may be substantially free of other substituents. The cellulose acetate butyrate of this example may have a molecular weight in the range 18,000 to 35,000 g $mol^{-1}$.

The molecular weight of the cellulose ester is not particularly limited, provided that the cellulose ester is capable of forming a film. It has been found that molecular weight does not have a significant impact on the barrier properties of the film. Typically, the cellulose ester has a molecular weight of at least 2,000 g $mol^{-1}$. In particular, the cellulose ester may have a molecular weight in the range 15,000 to 80,000 g $mol^{-1}$, optionally 18,000 to 35,000 g $mol^{-1}$, further optionally 18,000 to 22,000 g $mol^{-1}$.

The film may optionally further comprise one or more additives, such as a plasticizer. The nature of the plasticizer, if present, is not particularly limited provided that the plasticizer is compatible with the cellulose ester. Illustrative examples of plasticizers include triethyl citrate and dibutyl sebacate. Triethyl citrate is an example of a hydrophilic plasticizer. A hydrophilic plasticizer may increase the oil and grease resistance of the film. Tributyl sebacate is a hydrophobic plasticizer. A hydrophobic plasticizer may increase the moisture barrier resistance of the film.

The amount of plasticizer, if present, is not particularly limited and may be selected as appropriate. For example, the plasticizer may be present in the film in an amount in the range 15 to 25% by weight, based on the weight of the based on the weight of the cellulose ester.

A related aspect provides a composition comprising a mixture of a cellulose ester and a further film-forming material. The cellulose ester and the further film-forming material are present in the composition at a ratio in the range 0.1:1 to 10:1 by weight. The cellulose ester has ester substituents and free hydroxyl groups. The ester substituents of the cellulose ester are each independently selected from C2 to C6 alkyl ester groups. The free hydroxyl groups of the cellulose ester are present in an amount in the range 15% to 40 mol %.

The further film-forming material may allow the composition to be applied to a substrate more easily. For example, the further film-forming material may be used to adjust the viscosity of the composition. The further film-forming material may be selected such that, when the composition is dissolved in ethylene glycol diacetate, the resultant solution has a viscosity of less than or equal to 7500 mPa·s as measured at a temperature of 22±1° C. using a Brookfield viscometer operating at a spindle speed of 60 rpm. The spindle may be an LV 4 spindle.

Films may be manufactured using various techniques. Examples include casting, rod coating, and spraying. It is desirable for the solution to have a content of dissolved solids which is as high as possible, in order to allow a relatively thick film to be formed in a single operation, e.g. a single casting step. However, increasing the amount of cellulose ester in the solution increases the viscosity of the solution. If viscosity increases too much, then the solution becomes impractical to handle.

It has surprisingly been found that films comprising a mixture of the cellulose ester and a further film forming material retain the favourable barrier properties of the cellulose ester, as described above. Therefore, by adding the further film-forming material to the composition, solids content during processing may be increased without excessively increasing viscosity and without significantly impairing the technical performance of the film.

The composition may be in the form of a film, e.g. a film 120 as previously described with reference to FIG. 1. In particular, the film may be arranged on a paperboard substrate, as previously described.

Alternatively, the composition may further comprise a solvent and may be in the form of a solution. Any appropriate solvent may be used. The solvent may be an organic solvent. Examples of useful organic solvents include acetone, ethanol, and ethylene glycol diacetate. The solution is useful for manufacturing the film.

The solution may have a viscosity in the range 250 mPa·s to 7500 mPa·s. The solution may have a viscosity of less than or equal to 4500 mPa·s, or in the range 250 mPa·s to 4500 mPa·s. It has been found that compositions which can be dissolved to yield a solution having a viscosity in the range 250 mPa·s to 4500 mPa·s have particularly favourable handling properties.

The cellulose ester is a cellulose ester as described above. It is to be appreciated that the discussion of the cellulose ester set out above with reference to the FIG. 1 aspect are equally applicable to the composition aspect.

The cellulose ester may have a relatively high molecular weight, for example a molecular weight has a molecular weight in the range 15,000 to 80,000 g $mol^{-1}$, optionally in the range 18,000 to 35,000 g $mol^{-1}$, and further optionally in the range 18,000 to 22,000 g $mol^{-1}$.

The nature of the further film-forming material is not particularly limited, provided that the further film-forming material is compatible with the cellulose ester and that a solution having an acceptable viscosity can be obtained. The further film-forming material may be a polymer. Compatible polymers may be identified by casting a film comprising a mixture of the cellulose ester and the candidate further film-forming material onto a glass plate. If a clear film is obtained, then the further film-forming material is compatible.

Cellulose esters are compatible with most acrylics; polyesters such as polyhydroxyalkanoates; polyphenols; polyureas; and polyisocyanates. Other examples of compatible polymers include polyolefins such as polyethylene or polypropylene; poly(lactic acid); cellulose esters such as cellulose acetate; regenerated cellulose ("Cellophane"); polyamides such as polyamide 11; epoxies; polyvinyl acetates; and lignin.

The further film-forming material may be a bioplastic, in other words, a plastic produced from a renewable biomass starting material. Plastics from biological sources may be distinguished from plastics from fossil fuel sources by radiocarbon dating. Plastics produced from fossil fuel comprise substantially no $^{14}C$.

The further film-forming material may be a further cellulose ester, different from the cellulose ester having the free hydroxyl groups in an amount in the range 15 to 40 mol %. The cellulose ester having the free hydroxyl groups in an amount in the range 15 to 40 mol % is referred to herein as the "first cellulose ester".

The further cellulose ester may comprise free hydroxyl groups in an amount of less than or equal to 14 mol %, for example, less than or equal to 10 mol %.

The further cellulose ester may have a molecular weight in the range 1,000 to 14,000 g $mol^{-1}$, optionally in the range 2000 to 10000 g $mol^{-1}$, and further optionally a molecular weight in the range 3000 to 4000 g $mol^{-1}$. The further cellulose ester typically has a molecular weight which is lower than that of the first cellulose ester. For example, the molecular weight of the further cellulose ester may be at least 2,000 g $mol^{-1}$ lower than the molecular weight of the first cellulose ester.

The ester substituents of the further cellulose ester may each be independently selected from acetate ester groups, propionate ester groups, and butyrate ester groups.

The relative proportions of the first cellulose ester and the further film-forming material may be selected as appropriate. For example, the cellulose ester and the further film-forming material may be present in a ratio in the range 0.5:1 to 1.5:1 by weight, and optionally at a ratio in the range 0.8:1 to 1.2:1 by weight.

Figure 2:
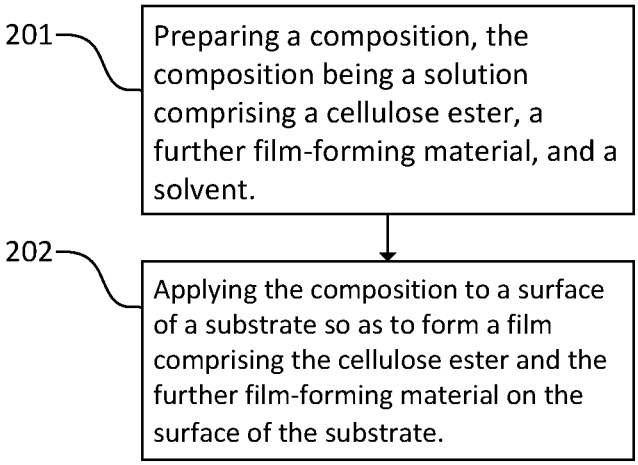
FIG. 2 is a flowchart outlining a method of manufacturing a packaging material.

A method of manufacturing a packaging material using the composition will now be described with reference to FIG. 2. FIG. 2 is a flowchart outlining the steps of the method.

At block 201, a solution comprising the composition dissolved in a solvent is prepared. Any appropriate technique may be used. For example, a solution of the cellulose ester and a solution of the further film-forming material may be prepared, and the two solutions may then be mixed together. Alternatively, the cellulose ester and further-film forming materials may be provided in the form of powders and may be stirred into the solvent. Preferably, the solution is prepared without the use of heating.

At block 202, the composition is applied to a surface of a substrate so as to form a film comprising the cellulose ester and the further film-forming material. For example, a film may be casted from the solution, or applied with a film applicator such as a Bird-type film applicator.

Figure 3:
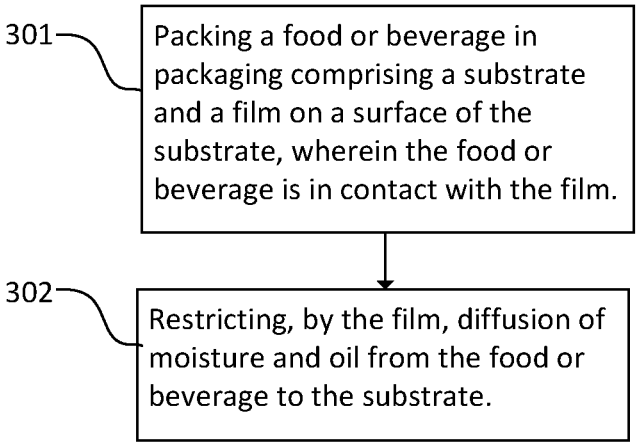
FIG. 3 is a flowchart outlining a method of storing a food or beverage.

A method of using the films as described herein as barriers against moisture and oil is illustrated in FIG. 3. FIG. 3 is a flow chart outlining the method.

At block 301, a food or beverage is packaged in packaging of the type described with reference to FIG. 1. The packaged food or beverage is in contact with the film.

At block 302, the film restricts diffusion of moisture and oil from the food or beverage to the substrate. The films provided herein act as barriers and may allow moist, perishable foods to be packaged in packaging materials comprising cellulosic substrates, such as paperboard substrates, moulded fibre substrates, or textile substrates.

After use, the packaging may be disposed of, e.g. by composting. Cellulosic substrates such as paperboard and the films provided herein are capable of disintegrating in a composting environment. This may limit the environmental impact of the packaging. The composting conditions may be adjusted to achieve a desired level of disintegration of the cellulose ester film, for example as described in Puls et al, J Polym Environ (2011) 19:152-165.

EXAMPLES

Example 1: Characterization of Cellulose Esters by Nuclear Magnetic Resonance Spectroscopy The structures of a set of six cellulose esters, Materials A to F, were investigated using $^{13}C$ nuclear magnetic resonance spectroscopy. Materials A to D were cellulose acetate butyrates. Material E was a carboxymethylated cellulose acetate butyrate. Material F was a cellulose acetate.

Approximately 120 mg of each cellulose ester was dissolved in 1 ml of deuterated dimethyl sulfoxide. The resultant samples were then analysed using a Bruker 400 Avance NMR instrument with a 5 mm BBO probe. The pulse program used was zgig30 and D1=20 s. The number of scans was 10,000 for each spectrum.

Figure 4:
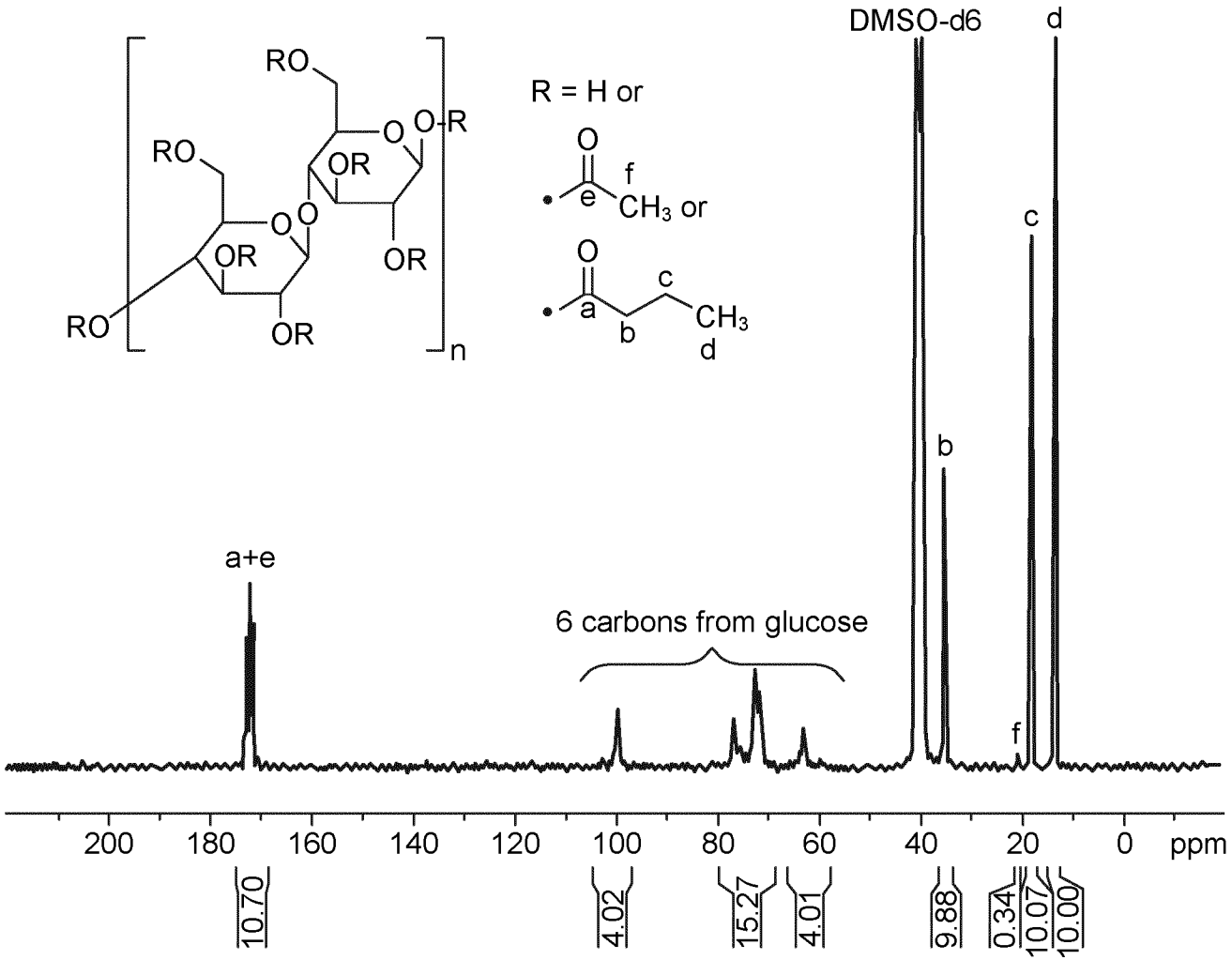
FIG. 4 is an annotated $^{13}C$ NMR spectrum for an example cellulose ester, as discussed in Example 1.

A $^{13}C$ NMR spectrum for Material 1 is shown in FIG. 4. The spectrum is annotated with identifications of peaks in the spectrum. Results of the analysis are set out in Table 1, below. The integral value for 1 carbon atom of the glucose ring is calculated as an average of the 6 carbons at shift 100 ppm to 55 ppm. The integral value for 1 carbon of the butyryl substitute is calculated as an average of signals c and d as identified in FIG. 1. The integral of 1 carbon of the acetyl substitute is calculated as the integral of signal f also identified in FIG. 1.

TABLE 1 results of NMR spectroscopy

| Material | Glucose ring integral for 1 carbon | Butyryl substitute integral for 1 carbon | Acetyl substitute integral for 1 carbon |
|---|---|---|---|
| Material A | 4.00 | 10.04 | 0.34 |
| Material B | 4.80 | 10.01 | 0.35 |
| Material C | 5.47 | 10.00 | 4.95 |
| Material D | 3.75 | 10.02 | 0.31 |
| Material E | 4.14 | 9.92 | 0.36 |
| Material F | 4.16 | 0.00 | 10.00 |

The degree of substitution ("DS") and the amount of each substituent present in each material was calculated from the NMR data. The results are shown in Table 2.

TABLE 2 amounts of substituents as determined by NMR

| Material | DS | free OH per glucose unit | Butyryl/Acetyl-molar ratio | Butyryl substitution/ mol % | Acetyl substitution/ mol % | OH substitution/ mol % |
|---|---|---|---|---|---|---|
| Material A | 2.60 | 0.40 | 29.5 | 84 | 3 | 13 |
| Material B | 2.16 | 0.84 | 28.6 | 69 | 3 | 28 |
| Material C | 2.73 | 0.27 | 2.0 | 46 | 45 | 9 |
| Material D | 2.75 | 0.25 | 32.3 | 89 | 3 | 8 |
| Material E | 2.48 | 0.52 | 27.6 | 80 | 3 | 17 |
| Material F | 2.41 | 0.59 | 0.0 | 0 | 80 | 20 |

Example 2: Preparation of Films of Single Cellulose Esters

A series of solutions each comprising a cellulose ester at a concentration of 10% by weight of the solution in acetone were prepared. Each solution further included a plasticizer selected from triethyl citrate or dibutyl sebacate, in an amount of 20% by weight based on the weight of the cellulose ester. The solutions were then casted onto either an aluminium substrate or an Avanta Prima substrate. Avanta Prima is a commercially available boxboard.

The physical properties of the cellulose esters investigated are set out in Table 3, below. Material A, Material B, Material C, and Material D are cellulose acetate butyrates. Material E is a carboxymethylated cellulose acetate butyrate. Material F is a cellulose acetate.

TABLE 3 properties of the cellulose esters investigated

| Trade name | $T_g$/°C | MWn/g mol$^{-1}$ | Butyryl content/ mol % | Acetyl content/ mol % | Free OH content/ mol % |
|---|---|---|---|---|---|
| Material A | 85 | 16,000 | 84 | 3 | 13 |
| Material B | 136 | 20,000 | 69 | 3 | 28 |
| Material C | 155 to 165 | 20,000 | 46 | 45 | 9 |
| Material D | 75 | 3,500 | 89 | 3 | 8 |
| Material E | 130 | — | 80 | 3 | 17 |
| Material F | 180 | 30,000 | n/a | 80 | 20 |

It was observed that Material F dissolved slowly in acetone, and formed a solution which was more viscous than the other solutions.

Example 3: Moisture Barrier Properties

The water absorbance of each of the films obtained in Example 2 was measured by Cobb testing, with a contact time of 300 seconds. The water vapour transmission rate, WVTR, of each of the films was also determined. Lower water absorbance and lower WVTR are indicative of better moisture barrier properties.

TABLE 4 moisture barrier properties of cellulose ester films

| | Material | Plasticizer | Water absorbance as measured by Cobb 300/g · m$^{-2}$ | WVTR/ g · m$^{-2}$ · day$^{-1}$ |
|---|---|---|---|---|
| 1 | Material A | Triethyl citrate | 14 | |
| 2 | Material A | Dibutyl sebacate | 6 | |
| 3 | Material B | Triethyl citrate | 4 | 83 |
| 4 | Material B | Dibutyl sebacate | 6 | 80 |
| 5 | Material C | Triethyl citrate | 3 | |
| 6 | Material C | Dibutyl sebacate | 4 | |
| 7 | Material D | Triethyl citrate | 13 | 103 |
| 8 | Material D | Dibutyl sebacate | 23 | 98 |
| 9 | Material E | Triethyl citrate | 4 | |
| 10 | Material E | Dibutyl sebacate | 3 | |
| 11 | Material F | Triethyl citrate | 7 | 92 |

Material B films showed the best moisture barrier performance, and Material D gave the worst moisture barrier performance.

A 30-minute (1800 second) Cobb test was also carried out for a film comprising Material B and dibutyl sebacate as a plasticizer. The film absorbed 7 g·m$^{-2}$ of water under these conditions. A water absorbance of less than or equal to 10 g·m$^{-2}$ after 30 minutes is desirable.

Example 4: Grease and Oil Barrier Properties

The oil and grease barrier properties of the films obtained in Example 2 were qualitatively assessed by visual inspection after contacting the films with olive oil. Photographs of films 1 to 11 following exposure to olive oil are shown in FIGS. 5A to 5K, respectively.

Films comprising Material B (FIGS. 5C and 5D), Material E (FIGS. 5I and 5J) and Material F (FIG. 5K) were found to have the greatest resistance to olive oil. These films were not visibly altered by the olive oil.

Films comprising Material A (FIGS. 5A and 5B), Material C (FIGS. 5E and 5F) and Material D (FIGS. 5G and 5H) had relatively poor resistance to olive oil.

The results suggest that oil and grease resistance is related to the relative amount of free-OH groups in the cellulose ester.

Material D is a very similar polymer to Material A, aside from having a smaller number-average molecular weight, and both polymers performed similarly in the olive oil test. This suggests that molecular weight does not have a significant impact on olive oil resistance.

Figure 5A:
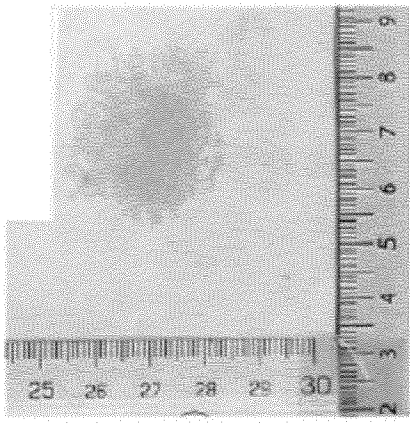
FIGS. 5A to 5K are photographs of films of various cellulose esters, taken after contacting the films with olive oil as discussed in Example 4.
Figure 5B:
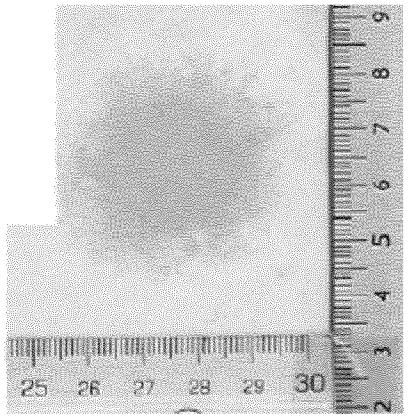
Figure 5C:
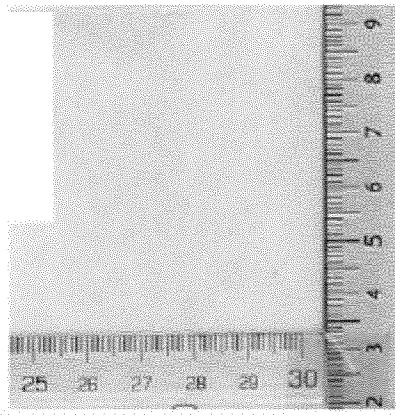
Figure 5D:
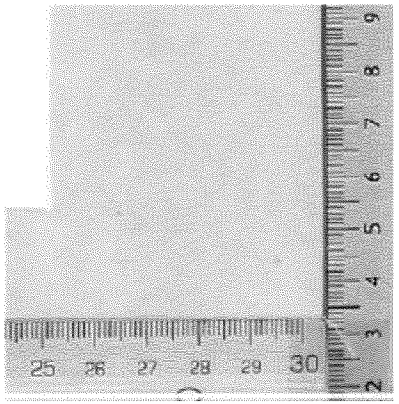
Figure 5E:
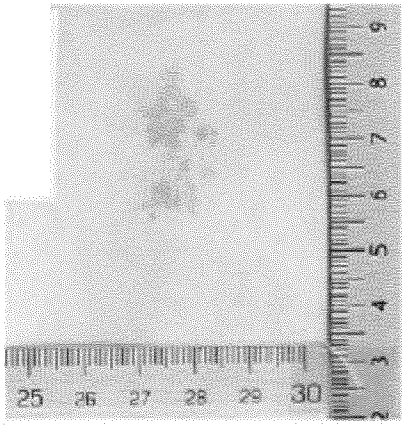
Figure 5F:
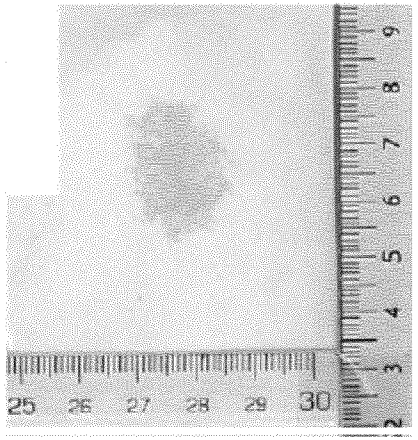
Figure 5G:
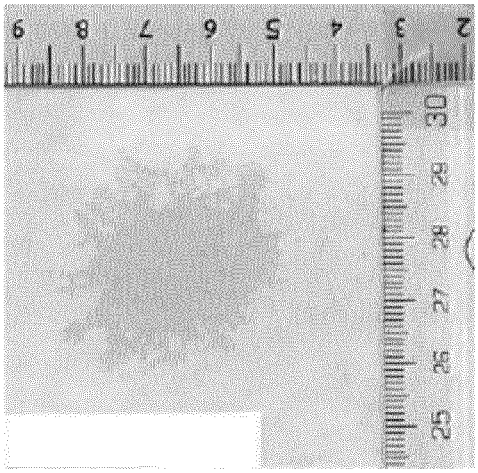
Figure 5H:
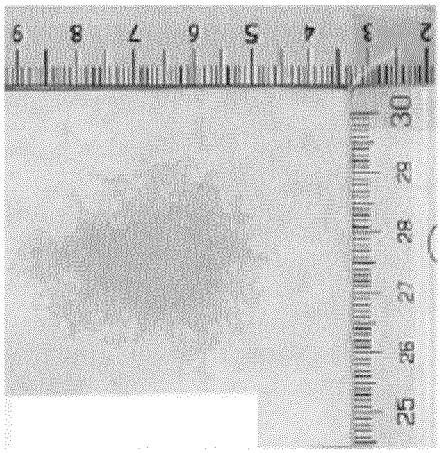
Figure 5I:
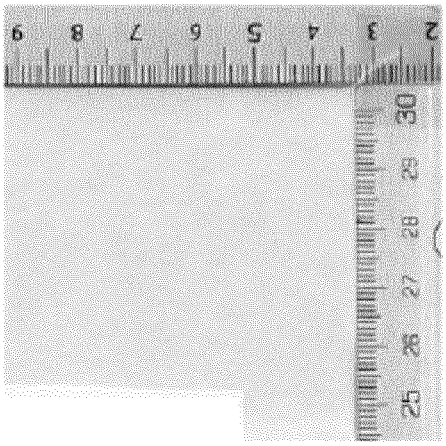
Figure 5J:
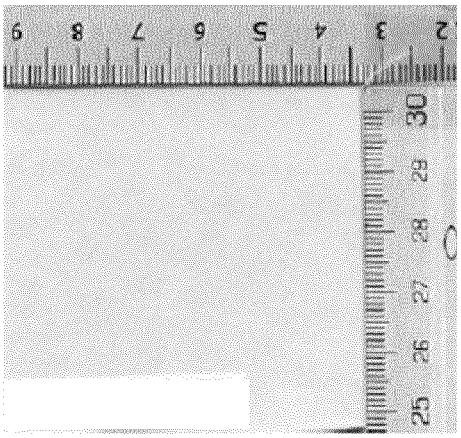
Figure 5K:
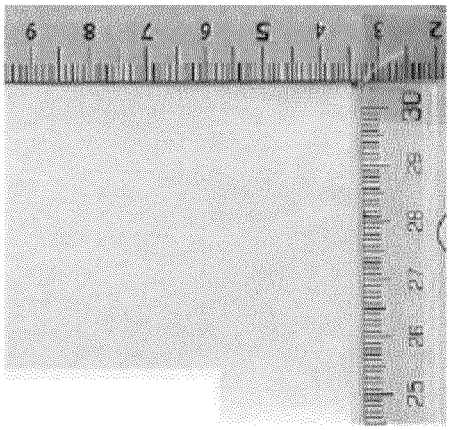

Films comprising triethyl citrate as the plasticizer were generally found to have better olive resistance than films comprising dibutyl sebacate (see, e.g., FIGS. 5A and 5B). This suggests that oil and grease barrier properties may be adjusted to some extent with plasticizer chemistry.

Example 5: Moisture Barrier Properties of the Blended Films

Solutions of cellulose esters were prepared as described in Example 2. Pairs of solutions were then mixed, by adding the more viscous solution of the pair to the less viscous solution of the pair, with efficient magnetic stirrer mixing. No heating was used. The ratio of the amounts of the polymers in each blend was 1:1 by weight, based on the weight of the polymers.

Films were then obtained by casting the blended solution onto aluminium and Avanta Prima boxboard substrates.

The water absorbance of each of the blended films was measured by Cobb testing, with a contact time of 300 seconds. The water vapour transmission rate, WVTR, of each of the films was also determined.

TABLE 5 moisture barrier properties of blended films

| Blend | Plasticizer | Cobb 300/ g · m$^{-2}$ | WVTR/ g · m$^{-2}$ · day$^{-1}$ |
|---|---|---|---|
| Materials B and D | None | 2 | 86 |
| Materials B and D | 10% dibutyl sebacate by weight of the blend | 2 | 80 |

TABLE 5-continued moisture barrier properties of blended films

| Blend | Plasticizer | Cobb 300/ $g \cdot m^{-2}$ | WVTR/ $g \cdot m^{-2} \cdot day^{-1}$ |
|---|---|---|---|
| Materials B and E | None | — | — |
| Materials D and F | None | — | — |
| Materials D and F | 10% triethyl citrate by weight of the blend | — | — |
| Materials E and F | None | — | — |

The blends comprising Material D and Material B were found to have favourable moisture barrier properties.

Example 6: Grease and Oil Barrier Properties of Blended Films

Figure 6A:
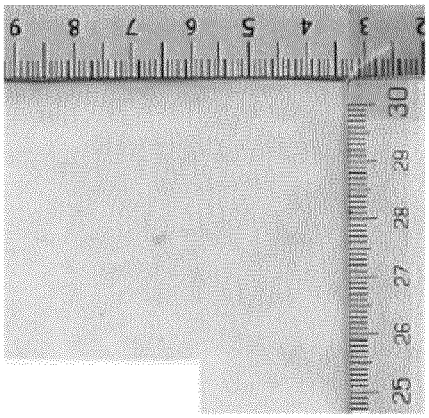
FIGS. 6A to 6B are photographs of films comprising blends of cellulose esters, taken after contacting the films with olive oil as discussed in Example 6.
Figure 6B:
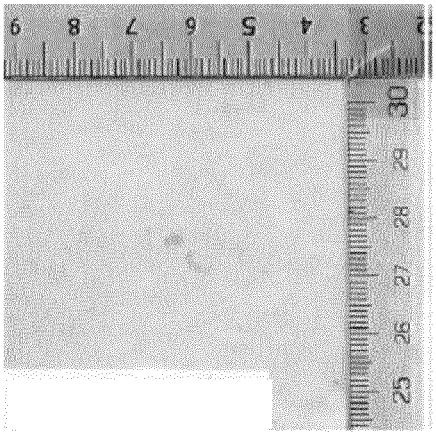

The olive oil resistance of the two blends comprising Material D and Material B was investigated. Photographs of the films are shown in FIGS. 6A and 6B. Both blends were found to have good resistance to olive oil.

The moisture and oil and grease barrier properties of the blended films were found to be dominated by the relatively higher molecular weight Material B component.

Example 7: Viscosity Measurements

The solutions shown in Table 6 were prepared in glass bottles. Where necessary in order to dissolve fully the cellulose esters, solutions were heated to 40-50° C. and mixed vigorously using a magnetic stirrer. The solutions were allowed to cool to room temperature (21-23° C.) prior to the viscosity measurements.

All viscosities were measured at room temperature (21-23° C.) using a Brookfield viscometer (model DV) using an LV 04 spindle operating at 60 rpm. The viscosity values are expressed in mPa·s (millipascal second). The numeric values of the viscosities are summarized in table 1.

Films were formed by applying the solutions onto paperboard substrates using a film applicator TQC sheen VF1501 and a 120 micrometer lid. The applicability of each solution is described in table 8.

It was found that solution 1 had the best applicability and levelling, despite having the highest solid content. Solution 9 was still applicable despite of very high viscosity, but was quite difficult to handle.

More generally, solutions which comprised a mixture Material B (which is an example of a cellulose ester having 15 to 30 mol % free OH groups) in combination with Material D (which is an example of a low molecular weight cellulose ester) had good applicability and, for a given solids content, were less viscous than a composition comprising a corresponding amount of Material B alone. This illustrates that mixing a cellulose ester having 15 to 30 mol % free OH groups with a further film-forming polymer may allow preparation of a solution having a high solids content and an acceptable viscosity.

TABLE 6 viscosities of various solutions of cellulose esters

| | Solution | | | | | | | | | |
|---|---|---|---|---|---|---|---|---|---|---|
| | 1 | 2 | 3 | 4 | 5 | 6 | 7 | 8 | 9 | 10 |
| Amount of EGDA | 140 | 140 | 70 | 140 | 93 | 93 | | | | |
| Amount of EtOH | | | 70 | | 40 | 40 | 90 | 90 | 70 | 65 |
| Amount of PEG-300 | | | | | | | 2 | 4 | 6 | |
| Amount of dibutyl sebacate | 12 | | | | | | | | | |
| Amount of triethyl citrate | | 10 | 10 | 10 | 10 | 10 | | | | |
| Amount of Material B | 20 | 25 | 25 | 17 | 17 | 17 | 10 | 20 | 30 | 35 |
| Amount of Material D | 40 | 25 | 25 | 33 | 33 | 33 | | | | |
| Viscosity/ mPa · s | 2720 | 3970 | 480 | 1700 | 350 | 360 | 50 | 500 | 7200 | Cannot be measured |
| Applicability | Very good. Very even surface. | Good. Even surface. | Moderate. Even surface. | Good. Even surface | Poor. Even surface | Poor. Even surface | Not applicable | Poor. Uneven surface. | Good. Even surface | Not applicable |

All amounts shown in Table 8 are in parts by weight.

The present disclosure provides the following clauses:

Clause 1. A composition comprising a mixture of a cellulose ester and a further film-forming material;

wherein the cellulose ester and the further film-forming material are present in the composition at a ratio in the range 0.1:1 to 10:1 by weight;

wherein the cellulose ester has ester substituents and free hydroxyl groups;

wherein the ester substituents of the cellulose ester are each independently selected from C2 to C6 alkyl ester groups;

wherein the free hydroxyl groups of the cellulose ester are present in an amount in the range 15% to 40 mol %;

and wherein the further film-forming material is selected such that, when the composition is dissolved in ethylene glycol diacetate, the resultant solution has a viscosity of less than or equal to 7500 mPa·s as measured at a temperature of 22±1° C. using a Brookfield viscometer operating at a spindle speed of 60 rpm.

Clause 2. The composition according to Clause 1, wherein the resultant solution has a viscosity in the range 250 mPa·s to 7500 mPa·s.

Clause 3. The composition according to Clause 1 or Clause 2, wherein the resultant solution has a viscosity of less than or equal to 4500 mPa·s.

Clause 4. The composition according to any of Clauses 1 to 3, wherein the cellulose ester and the further film-forming material are present in a ratio in the range 0.5:1 to 1.5:1 by weight.

Clause 5. The composition according to Clause 4, wherein the cellulose ester and the further film-forming material are present in a ratio in the range 0.8:1 to 1.2:1 by weight.

Clause 6. The composition according to any of Clauses 1 to 5, wherein the ester substituents of the cellulose ester are each independently selected from acetate ester groups, propionate ester groups, and butyrate ester groups.

Clause 7. The composition according to Clause 6, wherein the cellulose ester is a cellulose acetate butyrate.

Clause 8. The composition according to Clause 7, wherein the cellulose ester comprises butyl substituents in an amount in the range 65% to 75 mol %, and acetyl substituents in an amount in the range 2 to 5 mol %.

Clause 9. The composition according to any of Clauses 1 to 8, wherein the cellulose ester has a molecular weight has a molecular weight in the range 15,000 to 80,000 g $mol^{-1}$.

Clause 10. The composition according to Clause 9, wherein the cellulose ester has a molecular weight has a molecular weight in the range 18,000 to 35,000 g $mol^{-1}$.

Clause 11. The composition according to Clause 10, wherein the cellulose ester has a molecular weight in the range 18,000 to 22,000 g $mol^{-1}$.

Clause 12. The composition according to any of Clauses 1 to 11, wherein the free hydroxyl groups of the cellulose ester are present in an amount in the range 15 to 30 mol %.

Clause 13. The composition according to Clause 12, wherein the free hydroxyl groups of the cellulose ester are present in an amount in the range 20% to 30 mol %.

Clause 14. The composition according to Clause 13, wherein the free hydroxyl groups of the cellulose ester are present in an amount in the range 25% to 30 mol %.

Clause 15. The composition according to any of Clauses 1 to 14, wherein the further film-forming material is a further cellulose ester, and has a molecular weight in the range 1,000 to 14,000 g $mol^{-1}$.

Clause 16. The composition according to Clause 15, wherein the further film-forming material is a further cellulose ester, and has a molecular weight in the range 2000 to 10,000 g $mol^{-1}$.

Clause 17. The composition according to Clause 16, wherein the further film-forming material has a molecular weight in the range 3,000 to 4,000 g $mol^{-1}$.

Clause 18. The composition according to any of Clauses 15 to 17, wherein the ester substituents of the further cellulose ester are each independently selected from acetate ester groups, propionate ester groups, and butyrate ester groups.

Clause 19. The composition according to any of Clauses 15 to 18, wherein the further cellulose ester comprises free hydroxyl groups in an amount of less than or equal to 14 mol %.

Clause 20. The composition according to any of Clauses 1 to 19, further comprising a plasticizer.

Clause 21. The composition according to Clause 20, wherein the plasticizer is present in an amount in the range 15% to 25% by weight based on the weight of the composition.

Clause 22. The composition according to Clause 20 or Clause 21, wherein the plasticizer is triethyl citrate.

Clause 23. The composition according to any of Clauses 1 to 22, which is in the form of a film.

Clause 24. A packaging material comprising the composition according to Clause 23, wherein the film is a continuous film arranged on a surface of a substrate.

Clause 25. The packaging material according to Clause 24, wherein the substrate is a cellulosic substrate, optionally wherein the cellulosic substrate is selected from a paperboard substrate, a textile substrate, and a moulded fibre substrate; further optionally wherein the substrate is a textile substrate.

Clause 26. The composition according to any of Clauses 1 to 22, which is in the form of a solution further comprising a solvent.

Clause 27. The composition according to Clause 26, wherein the solvent is selected from acetone, ethanol, and ethylene glycol diacetate.

Clause 28. A method of manufacturing a packaging material, which method comprises:

preparing a composition as defined in Clause 26 or Clause 27; and applying the composition to a surface of a substrate so as to form a film comprising the cellulose ester and the further film-forming material on the surface of the substrate.

Clause 29. The method according to Clause 28, wherein the substrate is a cellulosic substrate, optionally wherein the cellulosic substrate is selected from a paperboard substrate, a textile substrate, and a moulded fibre substrate; further optionally wherein the substrate is a textile substrate.

Clause 30. Use of the composition according to Clause 23 as a barrier against moisture and oil.

Clause 31. Use of a film of a cellulose ester as a barrier against moisture and oil, the cellulose ester having free hydroxyl groups and ester substituents, wherein the ester substituents are each individually selected from C1 to C6 alkyl ester groups; and wherein the free hydroxyl groups are present in an amount in the range 15% to 40 mol %.

Clause 32. The use according to Clause 31, wherein the ester substituents are each individually selected from acetate ester groups, propionate ester groups, and butyrate ester groups.

Clause 33. The use according to Clause 32, wherein the cellulose ester is a cellulose acetate butyrate.

Clause 34. The use according to Clause 33, wherein the cellulose ester comprises butyl substituents in an amount in the range 65% to 75 mol %, and acetyl substituents in an amount in the range 2 to 5 mol %.

Clause 35. The use according to any of Clauses 31 to 34, wherein the free hydroxyl groups of the cellulose ester are present in an amount in the range 15 to 30 mol %.

Clause 36. The use according to Clause 35, wherein the free hydroxyl groups of the cellulose ester are present in an amount in the range 20% to 30 mol %.

Clause 37. The use according to any of Clauses 31 to 36, wherein the cellulose ester has a molecular weight in the range 15,000 to 80,000 g $mol^{-1}$.

Clause 38. The use according to Clause 37, wherein the cellulose ester has a molecular weight in the range 18,000 to 35,000 g $mol^{-1}$.

Clause 39. The use according to Clause 38, wherein the cellulose ester has a molecular weight in the range 18,000 to 22,000 g $mol^{-1}$.

Clause 40. The use according to any of Clauses 31 to 39, wherein the film further comprises a plasticizer.

Clause 41. The use according to Clause 40, wherein the plasticizer is triethyl citrate.

Clause 42. The use according to Clause 40 or Clause 41, wherein the plasticizer is present in the film in an amount in the range 15% to 25% by weight, based on the weight of the of the film.

Clause 43. The use according to any of Clauses 31 to 42, wherein the film is arranged on a surface of a cellulosic substrate.

Clause 44. Use according to any of Clauses 31 to 43, wherein the film is in contact with a food or beverage.

The invention claimed is:

1. A composition comprising a mixture of a first cellulose ester and a further film-forming material;

wherein the first cellulose ester and the further film-forming material are present in the composition at a ratio of 0.1:1 to 10:1 by weight;

wherein the first cellulose ester has a molecular weight, ester substituents, and free hydroxyl groups;

wherein the ester substituents of the first cellulose ester are each independently selected from C2 to C6 alkyl ester groups;

wherein the free hydroxyl groups of the first cellulose ester are present in an amount of 15 to 40 mol %;

wherein the further film-forming material is selected such that, when the composition is dissolved in ethylene glycol diacetate, the resultant solution has a viscosity of less than or equal to 7500 mPa·s as measured at a temperature of 22±1° C. using a Brookfield viscometer operating at a spindle speed of 60 rpm;

wherein the further film-forming material is a further cellulose ester having a molecular weight which is at least 2,000 g $mol^{-1}$ lower than the molecular weight of the first cellulose ester; and wherein the further cellulose ester comprises free hydroxyl groups in an amount of less than or equal to 14 mol %.

2. The composition according to claim 1, wherein the ester substituents of the first cellulose ester are each independently selected from acetate ester groups, propionate ester groups, and butyrate ester groups.

3. The composition according to claim 2, wherein the first cellulose ester is a cellulose acetate butyrate.

4. The composition according to claim 3, wherein the first cellulose ester comprises butyl substituents in an amount of 65 to 75 mol %, and acetyl substituents in an amount of 2 to 5 mol %.

5. The composition according to claim 1, wherein the molecular weight of the first cellulose ester is 15,000 to 80,000 g $mol^{-1}$.

6. The composition according to claim 1, wherein the free hydroxyl groups of the first cellulose ester are present in an amount of 15 to 30 mol %.

7. The composition according to claim 1, wherein the molecular weight of the further film-forming material is 1,000 to 14,000 g $mol^{-1}$.

8. The composition according to claim 7, wherein the further cellulose ester has ester substituents which are each independently selected from acetate ester groups, propionate ester groups, and butyrate ester groups.

9. The composition according to claim 1, which is in the form of a film.

10. A method, comprising:

packaging a food or beverage in packaging, the packaging comprising the substrate and a film arranged on a surface of the substrate, whereby the film restricts diffusion of moisture and oil and grease from the food or beverage to the substrate wherein the film is a film of a composition comprising a first cellulose ester and a further film-forming material, wherein the first cellulose ester and the further film-forming material are present in the composition at a ratio of 0.1:1 to 10:1 by weight;

wherein the first cellulose ester has a molecular weight, free hydroxyl groups, and ester substituents;

wherein the ester substituents are each individually selected from C1 to C6 alkyl ester groups; and wherein the free hydroxyl groups are present in an amount in the range 15 to 40 mol %;

wherein the further film-forming material is selected such that, when the composition is dissolved in ethylene glycol diacetate, the resultant solution has a viscosity of less than or equal to 7500 mPa, as measured at a temperature of 22±1° C. using a Brookfield viscometer operating at a spindle speed of 60 rpm;

wherein the further film-forming material is a further cellulose ester having a molecular weight which is at least 2,000 g $mol^{-1}$ lower than the molecular weight of the first cellulose ester; and wherein the further cellulose ester comprises free hydroxyl groups in an amount of less than or equal to 14 mol %.

11. The method according to claim 10, wherein the ester substituents are each individually selected from acetate ester groups, propionate ester groups, and butyrate ester groups.

12. The method according to claim 11, wherein the first cellulose ester is a cellulose acetate butyrate.

13. The method according to claim 10, wherein the free hydroxyl groups of the first cellulose ester are present in an amount of 15 to 30 mol %.

14. The method according to claim 10, wherein the first cellulose ester has a molecular weight of 15,000 to 80,000 g $mol^{-1}$.

15. The method according to claim 10, wherein the film is in contact with a food or beverage.

16. A packaging material, comprising:

a substrate; and a film arranged on a surface of the substrate, the film being a continuous film;

wherein the film comprises a composition which composition is a mixture of a first cellulose ester and a further film-forming material;

wherein the first cellulose ester and the further film-forming material are present in the composition at a ratio of 0.1:1 to 10:1 by weight;

wherein the first cellulose ester has a molecular weight, ester substituents, and free hydroxyl groups;

wherein the ester substituents of the first cellulose ester are each independently selected from C2 to C6 alkyl ester groups;

wherein the free hydroxyl groups of the first cellulose ester are present in an amount of 15 to 40 mol %;

wherein the further film-forming material is selected such that, when the composition is dissolved in ethylene glycol diacetate, the resultant solution has a viscosity of less than or equal to 7500 mPa·s as measured at a temperature of 22±1° C. using a Brookfield viscometer operating at a spindle speed of 60 rpm;

wherein the further film-forming material is a further cellulose ester having a molecular weight which is at least 2,000 g $mol^{-1}$ lower than the molecular weight of the first cellulose ester; and wherein the further cellulose ester comprises free hydroxyl groups in an amount of less than or equal to 14 mol %.

17. The composition according to claim 5, wherein the first cellulose ester has a molecular weight has a molecular weight of 18,000 to 35,000 g $mol^{-1}$.

18. The composition according to claim 6, wherein the free hydroxyl groups of the first cellulose ester are present in an amount of 20 to 30 mol %.

* * * * *